US006823682B1

(12) United States Patent
Jenkins et al.

(10) Patent No.: US 6,823,682 B1
(45) Date of Patent: Nov. 30, 2004

(54) ABSORPTIVE CHILLER WITH EVAPORATOR PROTECTION

(75) Inventors: Neil D. Jenkins, Collegeville, PA (US); David M. Martini, Liverpool, NY (US); Anthony Brancato, Huntington, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/756,566

(22) Filed: Jan. 13, 2004

(51) Int. Cl.[7] ..... F25B 15/00
(52) U.S. Cl. ..... 62/141; 62/476; 62/479
(58) Field of Search ..... 62/141, 476, 479, 62/482, 486, 492

(56) References Cited

U.S. PATENT DOCUMENTS 5,275,010 A * 1/1994 Hisajima et al. ..... 62/148
5,398,543 A * 3/1995 Fukushima et al. ..... 73/40.7

FOREIGN PATENT DOCUMENTS

EP 1199552 A2 * 4/2002 ..... 62/85

* cited by examiner

*Primary Examiner*—Melvin Jones
(74) *Attorney, Agent, or Firm*—Wall Marjama & Bilinski LLP

(57) ABSTRACT

An absorption chiller having a protection system for preventing the chilled water in the evaporator tubes from freezing in the event the water flow through the tubes closes down while the machine is running. A sensor in the evaporator heat exchanger is arranged to detect when the water flow through the heat exchanger tubes closes down and signals the machine controller. The controller, in turn, shuts down the machine and opens a valve in a feed line to the evaporator to deliver a high temperature working fluid from another section of the machine to the evaporator to maintain the temperature in the evaporator above that at which the water in the tubes freezes.

14 Claims, 2 Drawing Sheets

ABSORPTIVE CHILLER WITH EVAPORATOR PROTECTION

FIELD OF THE INVENTION

This invention relates generally to an absorption chiller and, in particular, to preventing the chilled water evaporator tubes from rupturing in the event the chilled water flow through the evaporator is inadvertently terminated while the system is operating.

BACKGROUND OF THE INVENTION

When the chilled water flow through an absorption chiller is closed down for some reason, the chiller's controls will sense the condition and take steps to shut the machine down. However, during the time that the flow stoppage is detected and the shut down procedures carried out, there is no heat input to the evaporator heat exchanger that is normally provided by the chilled water flow. As a consequence, because of the machines thermal inertia, the evaporators saturation temperature can drop substantially to a point below the freezing temperature of the water in the evaporator tubes causing the water in the tubes to freeze. This, in turn, can lead to the evaporator tubes rupturing resulting in the need for an extended machine down time while expensive repairs are carried out.

SUMMARY OF THE INVENTION

It is therefore an object of the present invention to improve absorption chillers.

A further object of the present invention is to protect the chilled water tubes inside of the evaporator of an absorption chiller from rupturing in the event the chilled water flow through the chiller is closed down for some reason while the chiller is operating.

A still further object of the present invention is to provide heat to the evaporator of an absorption chiller in the event the chilled water flow to the evaporator is inadvertently closed down.

BRIEF DESCRIPTION OF THE DRAWING

For a better understanding of these and other objects of the present invention reference will be made to the following detailed description of the invention which is to be read in association with the accompanying drawings wherein.

DETAILED DESCRIPTION OF THE INVENTION

Figure 1:
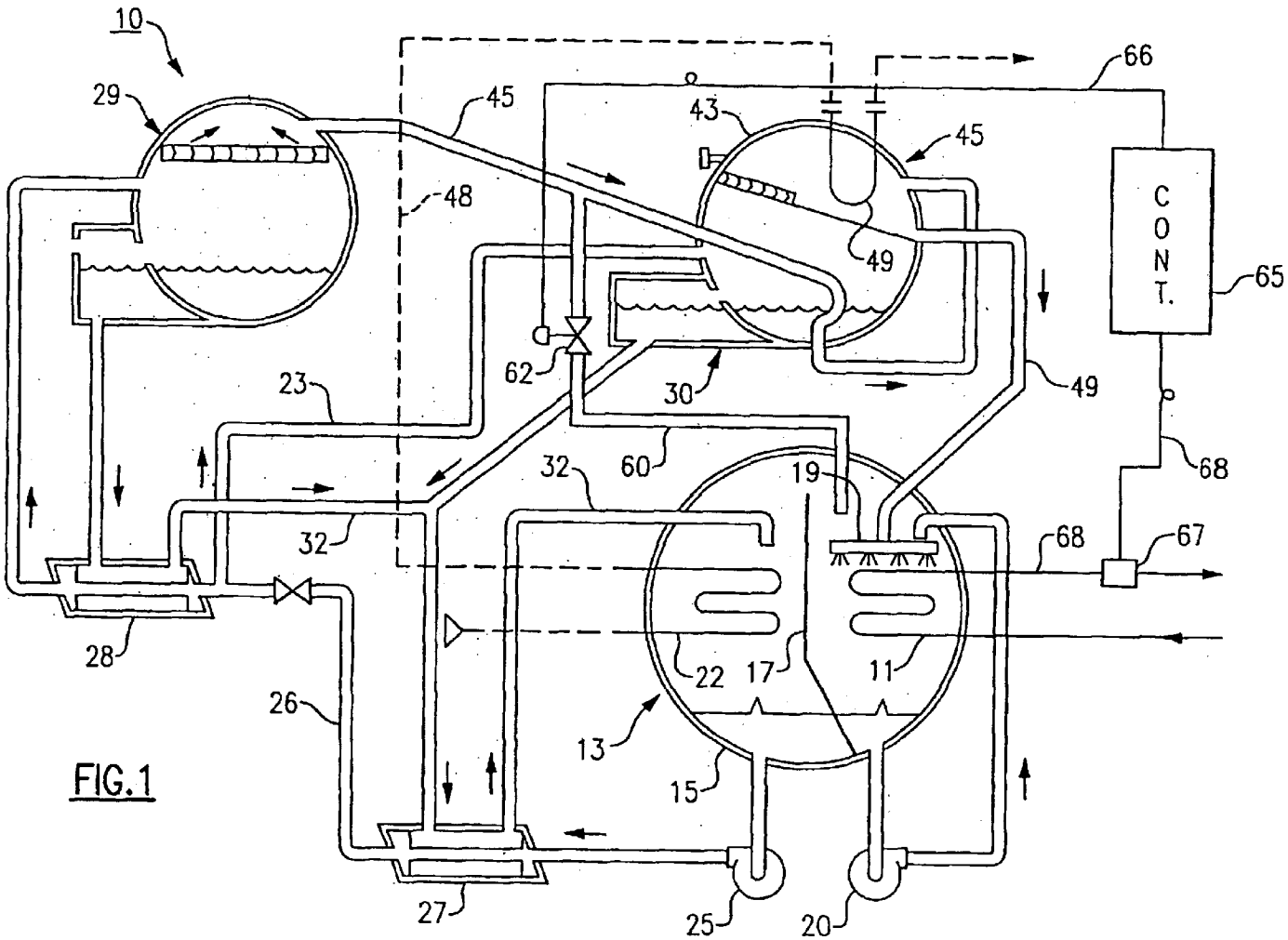
FIG. 1 is a schematic representation of a two stage absorption chiller embodying the teachings of the present invention.

Turning initially to FIG. 1 there is illustrated in schematic form the component parts of a two stage absorption chiller, generally referenced 10, that includes a first embodiment of the present invention. The machine is arranged to chill water that is passed through the tubes of a chilled water heat exchanger 11 located in the machines evaporator section 12. The evaporator 12 and the absorber 13 are mounted together in a single shell 15 in a side by side alignment. The absorber section is separated from the evaporator section by a wall 17.

The present chiller utilizes water as a refrigerant and lithium bromide as an absorbent. However, any other suitable combination of absorbent and refrigerant may be used in the practice of the present invention. As is normal in this type of system, a high vacuum pressure is maintained within the shell 15. The absorber is partially filled with a lithium bronide, and absorbs water vapor that is generated in the evaporator to form an absorptive solution. As will be explained in greater detail below, liquid refrigerant developed in the machine is delivered into a refrigerant spray header 19 within the evaporator and is sprayed over the tubes of the chilled water heat exchanger whereby the chilled water gives up heat to the evaporator as it flows through the heat exchanger.

A portion of the refrigerant in the evaporator is flash cooled at the low absolute shell pressure and passes over into the absorber section where it is absorbed by the lithium bromide. Liquid refrigerant that is collected in the sump of the evaporator is drawn off by the refrigerant pump 20 and recirculated through the refrigerant spray header 19. The heat that is developed within the absorber is carried off by cooling water that is passed through the tubes of the absorber heat exchanger 22. Although not shown, a cooling tower is placed in the cooling water loop wherein the heat carried off by the cooling water is rejected into the surrounding ambient.

The term weak solution will be used herein to define an absorptive solution that has a heavy concentration of refrigerant. The term strong solution on the other hand will be used herein to identify an absorptive solution wherein the concentration of refrigerant is relatively low. The term working fluid or working substance will be used to identify either refrigerant or solution containing lithium bromide and water in various concentrations.

Weak solution developed in the absorber, which is rich in refrigerant, is drawn from the absorber by a solution pump 25. The solution is passed by means of a solution delivery line 26 in series through a first low temperature solution heat exchanger 27 and a second high temperature heat exchanger 28 and is delivered into the chillers first stage high temperature generator 29. A portion of weak solution leaving the low temperature heat exchanger is diverted by a solution shunt line 23 to a second stage low temperature generator 30. The weak solution moving through the two heat exchangers is brought into a heat transfer relationship with higher temperature strong solution being carried back to the absorber via the solution return line 32 thereby raising the temperature of the weak solution.

After passing through the high temperature heat exchanger, the weak solution enters the systems high temperature generator 29. Although not shown, the high temperature generator is equipped with a heater or burner that is fired by any one of many well known fuels to further raise the temperature of the solution to a point where a portion of the refrigerant is taken out of solution in the form of a vapor. The refrigerant vapor produced in the high temperature generator is passed through the low temperature generator 30 via vapor line 41 prior to being delivered into the system condenser 45.

The second stage low temperature generator 30 is housed in a single shell 43 with the low temperature condenser 45. As the refrigerant from the high temperature generator passes through the low temperature generator it gives up additional heat to the solution in the generator to help drive the generator. That portion of the weak solution diverted from the low temperature solution heat exchanger enters the low temperature generator where the further refrigerant is vaporized. The vapor passed into the system condenser 45 where it is added to the refrigerant condensed in the second stage generator. Cooling water from the absorber is passed by cooling water line 48 through the system condenser heat exchanger 49 prior to returning to the cooling tower.

Liquid refrigerant produced in the system condenser 45 is gravity feed through return line 49 from the condenser sump to the spray header of the evaporator and, as explained above, passed over the tubes of the chilled water heat exchanger to chill the water as it is passed through the evaporator tubes.

A feed line 60 is connected into the vapor line 45 adjacent to the first stage generator and is arranged to gravity feed refrigerant from the high temperature generator into the evaporator. Although the feed line is shown connected into the vapor line, the feed line may be connected into any suitable location that will permit high temperature refrigerant from the high temperature generator to flow into the evaporator. A remotely controlled valve 62 is mounted in the feed line. The valve preferably is a solenoid actuated valve that is normally closed to prevent passage of vapor through the feed line under normal operating conditions.

The control valve 62 is connected to the machine controller 65 by means of electrical line 66. A flow sensor 67 is placed in the return line 68 of the chilled water loop and is arranged to detect when the flow of chilled water through the evaporator has closed down. Upon detecting such a condition, a signal is sent via line 68 to controller instructing the machine to shut down. At this time, the control valve in the feed line is opened permitting refrigerant to flow into the evaporator section. The refrigerant is in a state that it will provide sufficient heat to the evaporator to prevent the chilled water in the heat exchanger tubes from freezing and potentially rupturing the tubes during the period the machine is running through its shut down cycle.

Figure 2:
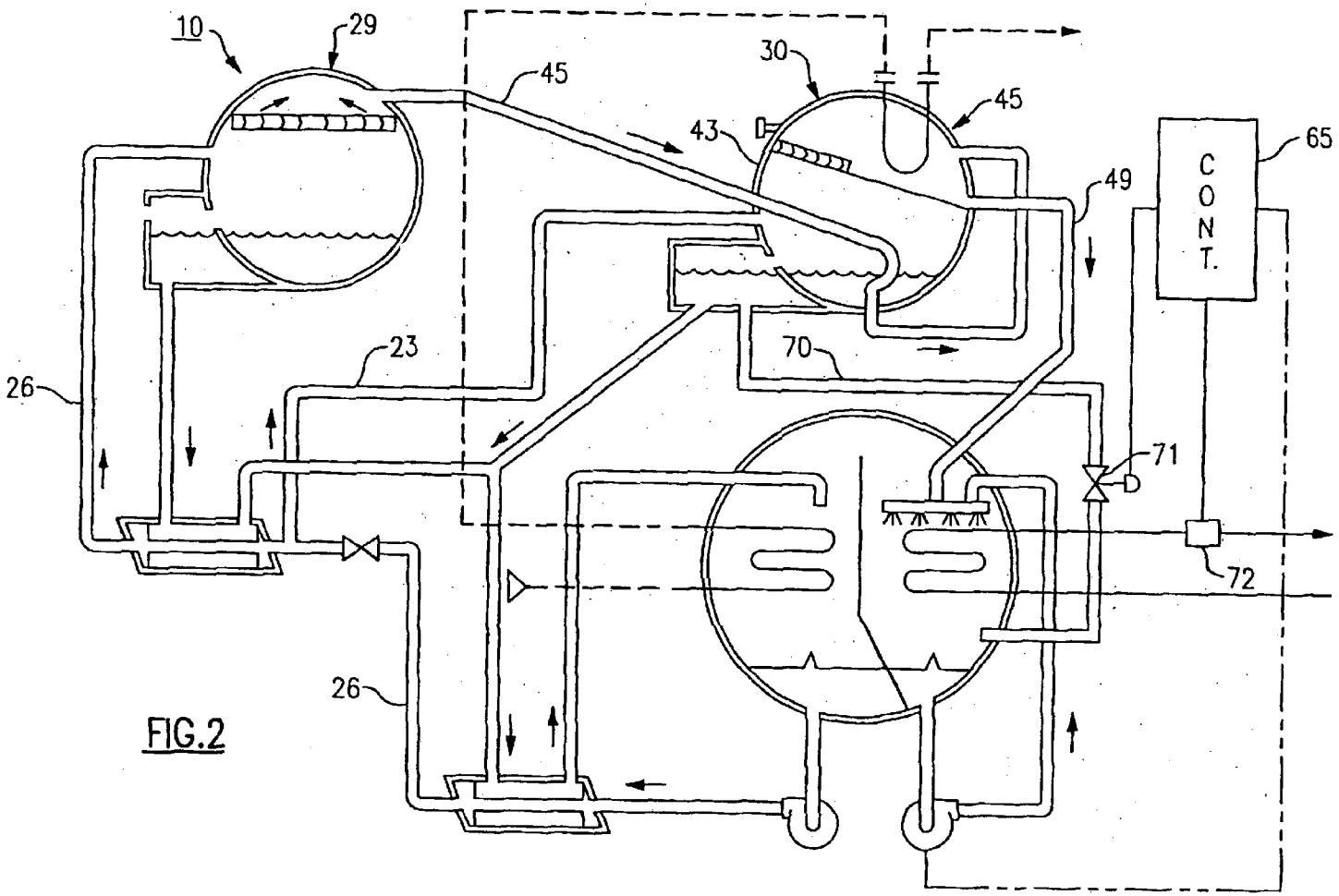
FIG. 2 is a schematic representation similar to that illustrated in FIG. 1 showing a further embodiment of the invention; and These and other objects of the present invention are attained in an absorption chiller having a mechanism for protecting the chilled water tubes of the evaporator section in the event the chilled water flow through the evaporator closes down while the machine is operating. The chilled water flow through the evaporator heat exchanger tubes is monitored and in the event the flow is closed down for some reason, a signal is sent to the machine controller to shut the machine down. The controller at the same time also opens a remotely controlled valve in a feed line, which, in turn, causes a high temperature working fluid from another section of the chiller to be delivered into the evaporator to maintain the temperature in the evaporator at a level such that the chilled water in the heat exchanger tubes is prevented from freezing.

Turning now to FIG. 2 there is illustrated a two stage absorption chiller similar to that illustrated in FIG. 1 wherein like numerals are used to identify like parts. In this embodiment of the invention solution is drawn in from the second or low stage generator 30 and diverted via a feed line 70 into the evaporator to again provide sufficient heat to the evaporator to prevent the chilled water trapped in the evaporator heat exchanger tubes from freezing. Here again, a remotely controlled solenoid valve 71 is placed in the feed line and a flow sensor 72 is mounted in one of the chilled water lines servicing the evaporator heat exchanger. Once the sensor detects a close down situation in the chilled water flow, the controller is instructed to begin the machines shut down procedures and the solenoid valve is opened to permit the solution from the second stage generator to be gravity feed into the evaporator. The controller may also at this time instruct the refrigerant pump to remain on thereby circulating the working fluids in the pump of the evaporator to be recirculated through the evaporator spray header.

FIG. 3 illustrates a still further embodiment of the invention. In this embodiment, the evaporator 80 and the absorber 81 are placed in separate shells 82 and 83 respectively. The absorber shell is mounted at a higher elevation with respect to the evaporator. A spray header 84 is mounted in the evaporator and is arranged to spray liquid refrigerant over the tubes of a chilled water heat exchanger 85. A refrigerant pump 86 is arranged to recirculate liquid refrigerant collected in the pump of the evaporator back through the spray header 84.

The absorber includes a spray header 90 that is adapted to spray strong solution from the second stage generator over a cooling water heat exchanger 91. Refrigerant from the evaporator is delivered into the absorber via line 92 where it is mixed with the strong solution to generate a concentrated weak solution. The weak solution is collected in the pump of the absorber. A solution pump 93 is arranged to circulate solution through the solution heat exchangers to the generators as explained in detail above.

A feed line 95 is mounted in the sump of the absorber and arranged to gravity feed weak solution into the evaporator. Here again a sensor 96 is mounted in one of the chilled water lines which sends a signal to the machine controller to shut the machine down in the event the chilled water flow is terminated. The controller also sends a signal to the control valve 97 in the feed line to open the valve and thus deliver weak solution to the evaporator to prevent the water in the evaporator heat exchanger tubes from freezing.

Although the feed lines used in the above described embodiments of the invention are arranged to gravity feed the selected working fluid to the evaporator, it should be clear to one skilled in the art that an auxiliary pump may be placed in the feed line to aid in the deliver of the working fluid into the evaporator where gravity feeding is not available.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method of protecting the chilled water tubes in the evaporator of an absorption machine in the event the chilled water flow through the evaporator is terminated while the machine is running that includes the steps of:

monitoring the flow of chilled water through the evaporator tubes, signaling the machine controller to initiate a machine shut down procedure in the event the chilled water flow has terminated; and delivering a working fluid from a high temperature region of the machine to said evaporator to raise the temperature within the evaporator above a level at which the water in said evaporator tubes freezes.

2. The method of claim 1 wherein said working fluid is a refrigerant.

3. The method of claim 2 wherein said refrigerant is drawn from a high temperature generator.

4. The method of claim 3 wherein the refrigerant is gravity fed to the evaporator through a feed line.

5. The method of claim 4 that includes the further step of mounting a normally closed solenoid valve in said feed line, said valve being arranged to open when the shut down procedure is initiated.

6. The method of claim 1 wherein said working fluid is an absorptive solution.

7. The method of claim 6 wherein said solution is drawn from a system condenser.

8. The method of claim 7 wherein said solution is gravity fed to the evaporator through a feed line.

9. The method of claim 1 that includes the further step of maintaining the refrigerant pump operative upon initiation of the shut down procedure whereby the working fluid in the evaporator sump is re-circulated through the evaporator.

10. The method of claim 6 wherein said solution is drawn from the absorber.

11. Apparatus for preventing water in the chilled water tubes of an absorption machines evaporator from freezing in the event the chilled water flow through the evaporator is terminated, wherein said apparatus includes:

means for sensing the flow of chilled water through the evaporator and sending a signal to a programmed controller for shutting down said machine, a feed line for delivering a high temperature working fluid to the evaporator; and a remotely controlled normally closed, valve in the feed line which is opened by a signal from said controller when the chilled water flow has terminated whereby said high temperature working fluid is delivered into the evaporator.

12. The apparatus of claim 11 wherein said feed line is arranged to connect a high temperature generator with the evaporator to feed refrigerant from said generator to said evaporator.

13. The apparatus of claim 12 wherein the refrigerant is gravity fed into said evaporator.

14. The apparatus of claim 11 wherein said feed line is arranged to feed solution from a condenser to the evaporator.

* * * * *